US007571975B2

(12) United States Patent
Lee et al.

(10) Patent No.: US 7,571,975 B2
(45) Date of Patent: Aug. 11, 2009

(54) DEFECT DETECTION DEVICE OF A PRINT HEAD AND METHOD OF DETECTING DEFECT OF A PRINT HEAD

(75) Inventors: Hwa-sun Lee, Suwon-si (KR); Jae-woo Chung, Suwon-si (KR); Seung-mo Lim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 370 days.

(21) Appl. No.: 11/302,400

(22) Filed: Dec. 14, 2005

(65) Prior Publication Data

US 2006/0125870 A1 Jun. 15, 2006

(30) Foreign Application Priority Data

Dec. 15, 2004 (KR) ..... 10-2004-0106519

(51) Int. Cl.
*B41J 29/393* (2006.01)

(52) U.S. Cl. ..... 347/19; 347/10; 347/13

(58) Field of Classification Search ..... 347/5, 347/9, 10, 11, 19, 14, 13
See application file for complete search history.

(56) References Cited

U.S. PATENT DOCUMENTS 6,375,299 B1 * 4/2002 Foster et al. ..... 347/19
6,435,672 B1 * 8/2002 Groninger et al. ..... 347/69

FOREIGN PATENT DOCUMENTS

EP 1 452 318 A1 9/2004

* cited by examiner

*Primary Examiner*—Lam S Nguyen
(74) *Attorney, Agent, or Firm*—Lee & Morse, P.C.

(57) ABSTRACT

A defect detection device of a printer head, and a method of detecting defects, including first to Nth actuators providing a driving force for ejecting ink to ink chambers; a vibration signal generator generating vibration signals for vibrating the first to Nth actuators; a first switch receiving the generated vibration signals and outputting the vibration signals to a Kth actuator among the first to Nth actuators; a second switch receiving vibration signals of one or more among the first to Nth actuators and outputting an Lth vibration signal that corresponds to a vibration signal of the Lth actuator adjacent to the Kth actuator among the received vibration signals; and a defect detector comparing the Lth vibration signal output from the second switch with the specific vibration signal of the Lth actuator when there is no defect in a printer head and detecting defects in the printer head.

25 Claims, 10 Drawing Sheets

DEFECT DETECTION DEVICE OF A PRINT HEAD AND METHOD OF DETECTING DEFECT OF A PRINT HEAD

BACKGROUND OF THE INVENTION

1. Field of the Invention

The present invention relates to a print head. More particularly, the present invention relates to a defect detection device for detecting defects such as cracks, adhesion failures, etc., in a print head, and a method of detecting defects in a print head.

2. Description of the Related Art

In general, an inkjet printer is a device for printing an image of a predetermined color by ejecting droplets of ink in a predetermined position on a print medium, e.g., a sheet of paper. There are two common types of ink ejection used in inkjet printers. One type is a bubble jet type, wherein an electro-thermal transducer generates bubbles in ink using a heat source, and ink is ejected by the force of the bubbles. The other type is a piezoelectric type, wherein an electro-mechanical transducer ejects ink by changing a volume of an ink chamber due to flexure of a piezoelectric body adjacent to the ink chamber.

FIG. 1 illustrates a conventional piezoelectric inkjet print head, and FIG. 2 illustrates details of a part of the print head of FIG. 1. Referring to FIGS. 1 and 2, a piezoelectric type inkjet print head may include piezoelectric actuators 20, an upper plate 30, ink chambers 40, a middle plate 50, and a lower plate 60. The actuators 20 may be provided on the upper plate 30, and may be structured so as to have thin piezoelectric plates with electrodes stacked thereon to apply a voltage to the piezoelectric plates. The actuators 20 may flex the upper plate 30, i.e., the upper plate 30 may be elastically deformed by the actuators 20 so as to change the volumes of the respective ink chambers 40. The ink chambers 40 may be filled with ink, which is ejected by driving of the actuators 20. Driving the actuators 20 generates a pressure change in the respective ink chambers 40, which causes ink to be ejected from, or, in another part of the cycle, drawn into, the ink chambers 40 because their volume is changed by driving the actuators 20. Passages (not shown) for ejecting ink may be provided in the middle plate 50. Nozzles (not shown) may be provided in the lower plate 60.

A conventional piezoelectric type of an inkjet print head having the above-described structure may be operated as follows. Note that, for clarity, the operation of only a single ink chamber will be described, although, of course, the print head may have many such chambers. Driving the actuator 20 with a first voltage, i.e., a voltage of a first polarity, causes it to flex, which, in turn, causes the upper plate 30 to deform, which, in turn, decreases the volume of the ink chamber 40. Ink inside the ink chamber 40 is ejected to the outside through nozzles of the lower plate 60 by a pressure change caused by the decreased volume of the ink chamber 40. Thereafter, driving the actuator 20 with a voltage of a second polarity causes the upper plate 30 to return to its original shape, increasing the volume of the ink chamber 40. This causes ink to be drawn into the ink chamber 40, due to a pressure change resulting from the increased volume of the ink chambers 40.

The conventional piezoelectric inkjet print head may develop cracks where the upper plate 30 contacts the actuator 20, as indicated by the circled contact region 70 in FIG. 2. In particular, the upper plate 30 is relatively thin over the ink chambers 40 in the contact region 70. Therefore, there is a greater likelihood that a crack will occur in the contact region 70 as compared to other regions.

Another issue affecting the conventional piezoelectric inkjet print head is that adhesion between the upper plate 30 and the middle plate 50 may be poor. Then, as shown in FIG. 2, a separation or aperture may occur in the adhesion region 80 between the upper plate 30 and the middle plate 50. If such an aperture occurs, ink from the ink chambers 40 may leak into the aperture, with detrimental effects on the ability of the print head to correctly eject ink, depending as it does on a pressure change in the ink chamber 40.

SUMMARY OF THE INVENTION

The present invention is therefore directed to a print head defect detection device and method of detecting defects in a print head, which substantially overcome one or more of the problems due to the limitations and disadvantages of the related art.

It is therefore a feature of an embodiment of the present invention to provide a print head defect detection device that uses actuators on the print head to provide signals indicative of defects.

It is therefore another feature of an embodiment of the present invention to provide a print head defect detection device that drives and senses an actuator on the print head to provide a signal indicative of defects.

It is therefore yet another feature of an embodiment of the present invention to provide a method of detecting defects in a print head that uses signals produced by one or more actuators on the print head.

At least one of the above and other features and advantages of the present invention may be realized by providing a defect detection device of a print head including first to Nth (N is a positive integer) actuators providing a driving force for ejecting ink to ink chambers, a vibration signal generator generating vibration signals for vibrating the first to Nth actuators, a first switch receiving the generated vibration signals and outputting the vibration signals to a Kth (K is any integer ranging from 1 to N) actuator among the first to Nth actuators, a second switch receiving vibration signals of one or more among the first to Nth actuators vibrating concurrently with the vibration of the Kth actuator and outputting an Lth vibration signal, which corresponds to a vibration signal of an Lth actuator (L is any integer ranging from 1 to N) adjacent to the Kth actuator, from among the received vibration signals, and a defect detector comparing the Lth vibration signal output from the second switch with a specific vibration signal of the Lth actuator, the specific vibration signal of the Lth actuator derived from a print head having no defects, and detecting defects in the print head.

The vibration signal generator may generate sinusoidal waveforms. The defect detection device of a print head may further include an amplifier amplifying the Lth vibration signal output from the second switch and outputting the amplified Lth vibration signal to the defect detector. The defect detector may include an analog-digital converter converting the Lth vibration signal output from the second switch into a digital signal, and a defect determination unit comparing the Lth vibration signal converted into a digital signal with the specific vibration signal, which is a digital signal, and determining if the print head has defects. The Lth vibration signal may mean a change of a maximum voltage depending on a frequency change generated by the vibration of the Lth actuator, and the defect determination unit may determine if the print head has defects depending on whether an Lth vibration signal frequency having a largest maximum voltage change corresponds to a specific vibration signal frequency having a largest maximum voltage change.

At least one of the above and other features and advantages of the present invention may also be realized by providing a defect detection device of a print head including first to Nth (N is a positive integer) actuators providing a driving force for ejecting ink to ink chambers a vibration signal generator generating vibration signals for vibrating the first to Nth actuators, a switch receiving the generated vibration signals and outputting the vibration signals to a Kth (K is any integer ranging from 1 to N) actuator among the first to Nth actuators, and a defect detector receiving the Kth vibration signal of the Kth actuator that is made to vibrate by the vibration signals, comparing the received Kth vibration signal with a specific vibration signal of the Kth actuator, the specific vibration signal of the Kth actuator derived from a print head having no defects, and detecting defects in the print head.

The vibration signal generator may generate sinusoidal waveforms. The defect detection device of a print head may further include an amplifier amplifying the Kth vibration signal and outputting the amplified Kth vibration signal to the defect detector. The defect detector may include an analog-digital converter converting the Kth vibration signal into a digital signal, and a defect determination unit comparing the Kth vibration signal converted into a digital signal with the specific vibration signal that is a digital signal and determining if the print head has defects. The Kth vibration signal may reflect a frequency of an admittance generated by the vibration of the Kth actuator, and the defect determination unit may determine if the print head has defects depending on whether a Kth vibration signal frequency having a largest admittance change corresponds to a specific vibration signal frequency having a largest admittance change.

At least one of the above and other features and advantages of the present invention may further be realized by providing a method of detecting defects in a print head including (a) generating vibration signals for vibrating first to Nth (N is one or more positive integer) actuators, (b) receiving the generated vibration signals and outputting the vibration signals to a Kth (K is any integer ranging from 1 to N) actuator among the first to Nth actuators, (c) receiving vibration signals of one or more of the first to Nth actuators vibrating concurrently with the vibration of the Kth actuator and outputting an Lth vibration signal, which corresponds to a vibration signal of an Lth (L is any integer ranging from 1 to N) actuator adjacent to the Kth actuator, from among the received vibration signals, and (d) comparing the Lth vibration signal with a specific vibration signal of the Lth actuator, the specific vibration signal of the Lth actuator derived from a print head having no defects, and detecting defects in the print head.

In generating the vibration signals, sinusoidal waveforms may be generated. The method of detecting defects in a print head may further include amplifying the Lth vibration signal after receiving the vibration signals of one or more of the first to Nth actuators and before comparing the Lth vibration signal with the specific vibration signal of the Lth actuator. Comparing the Lth vibration signal with the specific vibration signal of the Lth actuator may include (d1) converting the Lth vibration signal into a digital signal, and (d2) comparing the Lth vibration signal converted into a digital signal with the specific vibration signal of the Lth actuator, which is a digital signal, and determining if the print head has defects. In comparing the Lth vibration signal with the specific vibration signal of the Lth actuator, the Lth vibration signal may mean a change of a maximum voltage depending on a frequency change generated by the vibration of the Lth actuator, and defects in the print head may be determined depending on whether an Lth vibration signal frequency having a largest maximum voltage change corresponds to a specific vibration signal frequency having a largest maximum voltage change.

At least one of the above and other features and advantages of the present invention may also be realized by providing a method of detecting defects in a print head including (a) generating vibration signals for vibrating first to Nth (N is one or more positive integer) actuators, (b) receiving the generated vibration signals and outputting the vibration signals to a Kth (K is any integer ranging from 1 to N) actuator among the first to Nth actuators, and (c) receiving a Kth vibration signal of the Kth actuator that is made to vibrate by the vibration signals, comparing the received Kth vibration signal with a specific vibration signal of the Kth actuator, the specific vibration signal of the Kth actuator derived from a print head having no defects, and detecting defects in the print head.

In generating the vibration signals, sinusoidal waveforms may be generated. The method of detecting defects in a print head may further include amplifying the Kth vibration signal after receiving the generated vibration signals and before receiving the Kth vibration signal. Receiving the Kth vibration signal may include (c1) converting the Kth vibration signal into a digital signal, and (c2) comparing the Kth vibration signal converted into a digital signal with the specific vibration signal of the Kth actuator, which is a digital signal, and determining if the print head has defects. In comparing the Kth vibration signal with the specific vibration signal of the Kth actuator, the Kth vibration signal may reflect a frequency of an admittance generated by the vibration of the Kth actuator, and defects in the print head may be determined depending on whether a Kth vibration signal frequency having a largest admittance change corresponds to a specific vibration signal frequency having a largest admittance change.

At least one of the above and other features and advantages of the present invention may be realized by providing a method of detecting defects in a print head including (a) generating vibration signals for vibrating first to Nth (N is one or more positive integer) actuators, (b) receiving the generated vibration signals and outputting the vibration signals to a Kth (K is any integer ranging from 1 to N) actuator among the first to Nth actuators, (c) receiving vibration signals of one or more of the first to Nth actuators vibrating concurrently with the vibration of the Kth actuator and outputting an L1th vibration signal, which corresponds to a vibration signal of an Lth (L is any integer ranging from 1 to N) actuator adjacent to the Kth actuator, from among the received vibration signals, (d) generating the vibration signal again, (e) receiving the generated vibration signal and outputting the vibration signal to an Mth (M is any integer ranging from 1 to N) actuator adjacent to the Lth actuator among the first to Nth actuators, (f) receiving vibration signals of one or more of the first to Nth actuators vibrating concurrently with the vibration of the Mth actuator and outputting an L2th vibration signal, which corresponds to another vibration signal of the Lth actuator among the received vibration signals, and (g) comparing the L1th vibration signal with a specific vibration signal of the Lth actuator, the specific vibration signal of the Lth actuator derived from a print head having no defects, comparing the L2th vibration signal with the specific vibration signal of the Lth actuator, and detecting defects in the print head.

In generating the vibration signals, sinusoidal waveforms may be generated. The method of detecting defects in a print head may further include a step of amplifying the L1th vibration signal after receiving the vibration signals and before generating the vibration signal again, and a step of amplifying the L2th vibration signal after receiving the vibration signals and before comparing the L1th vibration signal with the specific vibration signal of the Lth actuator. Comparing the L1th vibration signal with the specific vibration signal of the Lth actuator may include (g1) converting the L1th vibration signal and the L2th vibration signal into digital signals, and (g2) comparing the L1th vibration signal converted into a digital signal with the specific vibration signal of the Lth actuator, which is a digital signal, comparing the L2th vibration signal converted into a digital signal with the specific vibration signal of the Lth actuator, and determining if the print head has defects. In comparing the L1th vibration signal with the specific vibration signal of the Lth actuator, the L1th vibration signal and the L2th vibration signal, respectively, may mean a change of a maximum voltage depending on a frequency change generated by the vibration of the Lth actuator, and defects in the print head may be determined depending on whether a first frequency having the largest of maximum voltage changes of the L1th vibration signal and a second frequency having the largest of maximum voltage change of the L2th vibration signal corresponds to frequency having the largest of maximum voltage changes of a specific vibration signal.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
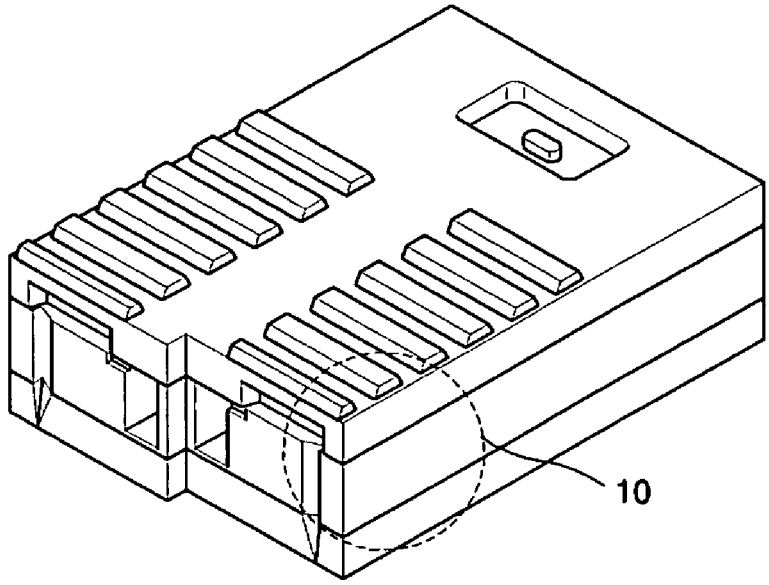
FIG. 1 illustrates a diagram of an embodiment of an inkjet print head in a conventional piezoelectric method.
Figure 2:
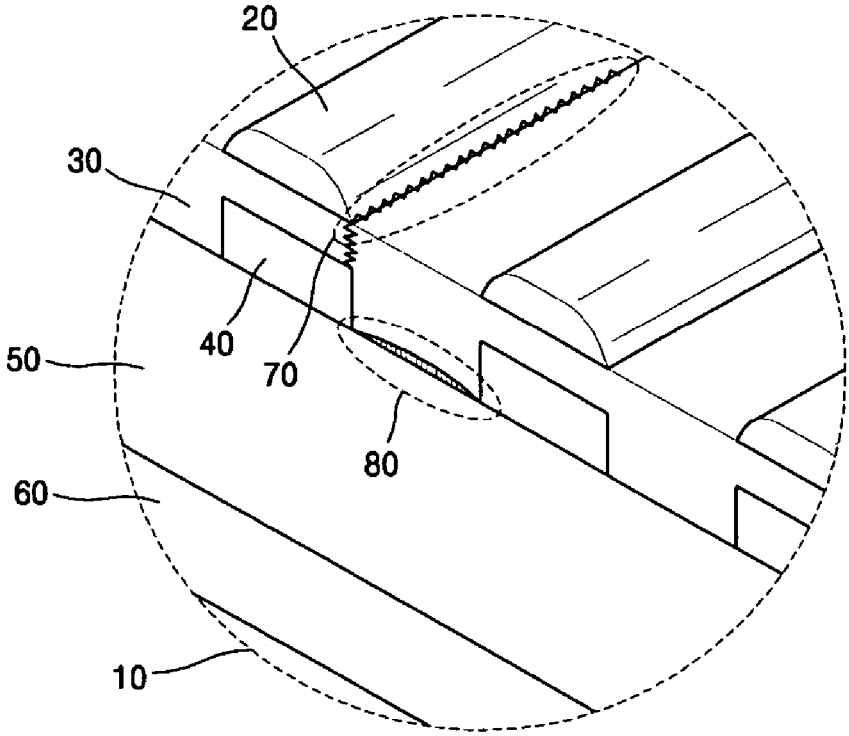
FIG. 2 illustrates in detail a diagram of a part of the inkjet print head shown in FIG. 1.

Korean Patent Application No. 10-2004-0106519, filed on Dec. 15, 2004, in the Korean Intellectual Property Office, and entitled, "Defect Detection Device of a Print head And Method of Detecting Defect of a Print head," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 3:
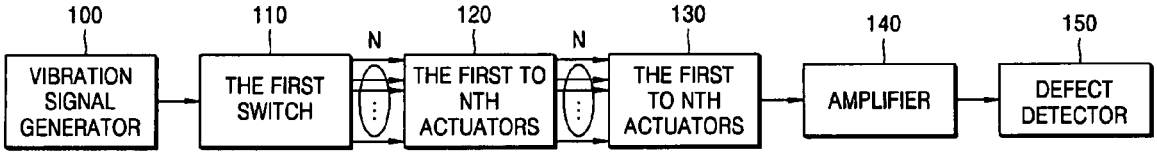
FIG. 3 illustrates a block diagram of an embodiment for explaining a defect detection device of a print head according to the present invention.

FIG. 3 illustrates a block diagram of an embodiment for explaining a defect detection device of a print head according to the present invention, where the defect detection device includes a vibration signal generator 100, a first switch 110, first to Nth actuators 120, a second switch 130, an amplifier 140 and a defect detector 150.

The first to Nth (N is one or more positive integer) actuators 120 provide a driving force for ejecting ink to ink chambers. The first to Nth actuators 120 are situated in an upper part of the print head and change volumes of the ink chambers (not shown). The first to Nth actuators 120 allow ink to eject to the outside through nozzles from the ink chambers by changing volumes of the ink chambers.

The vibration signal generator 100 generates vibration signals for vibrating the first to Nth actuators 120 and outputs the generated vibration signals to the first switch 110. The vibration signal generator 100 can generate waveforms of various kinds of vibration signals. Specifically, it may generate sinusoidal waveforms in the present invention. The first to Nth actuators 120 are vibrated by the vibration signals.

The first switch 110 receives the generated vibration signals and outputs vibration signals to a Kth (K is any integer ranging from 1 to N) actuator among the first to Nth actuators 120. The first switch 110 outputs vibration signals to the Kth actuator among the first to Nth actuators 120 in order to check whether a crack or an aperture occurs around the Kth actuator. The Kth actuator is vibrated by the received vibration signals.

The second switch 130 receives vibration signals of one or more among the first to Nth actuators vibrating concurrently with vibrating of the Kth actuator and outputs an Lth vibration signal that corresponds to a vibration signal of an Lth (L is any integer ranging from 1 to N) actuator adjacent to the Kth actuator among the received vibration signals to the amplifier 140. Specifically, a vibration signal means a change of a maximum voltage depending on a frequency change measured from a vibrating actuator. When the actuator is vibrated, a voltage is generated by physical characteristics of the actuator. A maximum voltage change depending on a frequency change of vibration signals for such a generated voltage can be detected. The second switch 130 receives such a maximum voltage change as vibration signals.

Actuators around the Kth actuator are also vibrated when the Kth actuator is vibrated by vibration signals generated from the vibration signal generator 100. The second switch 130 outputs the Lth vibration signal, produced by vibration of the Lth actuator adjacent directly to the Kth actuator among the actuators around the Kth actuator, to the amplifier 140.

The amplifier 140 amplifies the Lth vibration signal output from the second switch 130 and outputs the amplified Lth vibration signal to the defect detector 150.

The defect detector 150 compares the Lth vibration signal amplified from the amplifier 140 with a specific vibration signal of the Lth actuator, which is indicative of no defect in the print head, and detects defects in the print head. The specific vibration signal means a maximum voltage change depending on a frequency change measured from the first to Nth actuators 120 when defects, such as a crack, an adhesion failure, and so on, do not occur in the print head having the first to Nth actuators 120. Vibration signals corresponding to a maximum voltage change depending on a frequency change show the same shape in all of the first to Nth actuators 120 of the print head having no defect. That is, vibration signals of the first to Nth actuators 120 of the print head having no defect show that frequency. In other words, the resonance frequency is the same at the level of the highest value of maximum voltage change.

Figure 4:
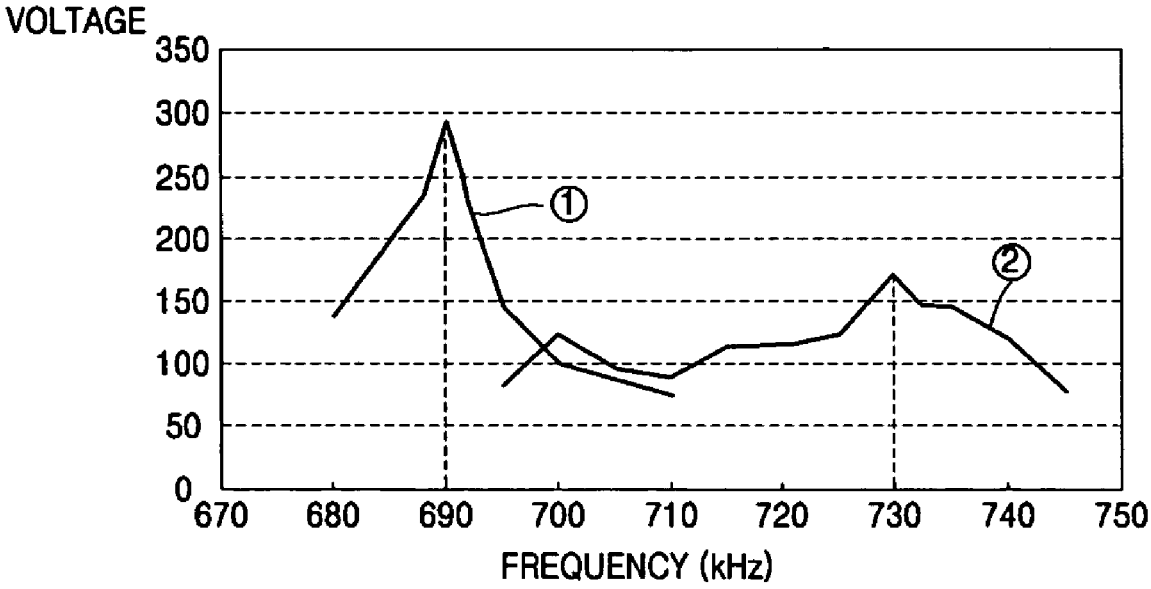
FIG. 4 illustrates a diagram of an embodiment of specific vibration signal detected from an actuator of a print head having no defect and vibration signal detected from an actuator of a print head having defects.

FIG. 4 illustrates a diagram of an embodiment of specific vibration signal detected from an actuator of a print head having no defect and vibration signal detected from an actuator of a print head having defects. Graph ① shown in FIG. 4 shows the specific vibration signal detected from the actuator of the print head having no defect, and graph ② shown in FIG. 4 shows the vibration signal detected from the actuator of the print head having a defect. When there is no defect in the print head, the vibration signal detected from the actuator has the same resonance frequency, 690 kHz, as on the graph ① shown in FIG. 4. However, when there are defects in the print head, vibration signals detected from the actuator have a resonance frequency, 730 kHz on the graph ② shown in FIG. 4, which is different from the resonance frequency 690 kHz of the graph ① shown in FIG. 4.

The reason that the resonance frequency is different is that the vibration of the Kth actuator is not properly transmitted to the Lth actuator due to defects, such as a crack or adhesion failure, etc., between the Kth actuator and the Lth actuator.

Figure 5:
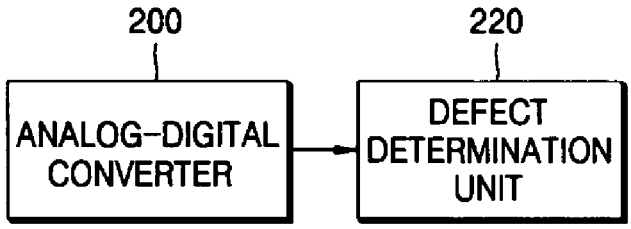
FIG. 5 illustrates a block diagram of an embodiment for explaining a defect detector shown in FIG. 3.

FIG. 5 illustrates a block diagram of an embodiment for explaining a defect detector 150 shown in FIG. 3, where the defect detector 150 includes an analog-digital converter 200 and a defect determination unit 220.

The analog-digital converter 200 converts the Lth vibration signal into a digital signal and outputs the converted signal to the defect determination unit 220.

The defect determination unit 220 compares the Lth vibration signal converted into a digital signal with the specific vibration signal that is a digital signal and determines if there are defects in the print head.

The defect determination unit 220 determines if the print head has defects depending on whether an Lth vibration signal frequency having the largest value among maximum voltage change corresponds to a specific vibration signal frequency having the largest value among maximum voltage change, where the Lth vibration signal means a change in frequency of a maximum voltage generated by the vibration of the Lth actuator.

Figure 6:
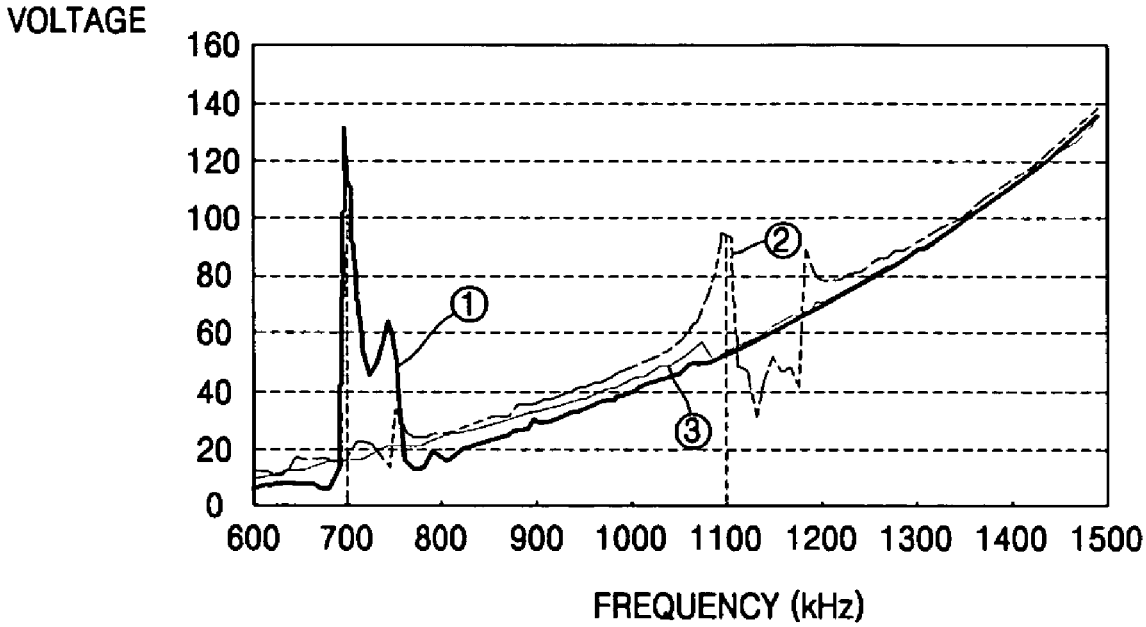
FIG. 6 illustrates a diagram of another embodiment of specific vibration signal detected from an actuator of a print head having no defect and vibration signal detected from an actuator of a print head having defects.

FIG. 6 illustrates a diagram of another embodiment of specific vibration signal detected from an actuator of a print head having no defect and vibration signal detected from an actuator of a print head having defects. Graph ① shown in FIG. 6 shows the specific vibration signal detected from the actuator of the print head having no defect and graph ② shown in FIG. 6 shows the vibration signal detected from the actuator of the print head having defects such as adhesion failure. Graph ③ shown in FIG. 6 shows a vibration signal detected from the actuator of the print head having a defect such as a crack. When there is no defect in the print head, vibration signals detected from the actuator have the same resonance frequency, 700 kHz, as shown on graph ① in FIG. 6. However, when there are defects in the print head due to occurrence of an aperture arising from adhesion failure, vibration signals detected from the actuator show a resonance frequency, 1100 kHz on graph ② shown in FIG. 6, different from the resonance frequency 700 kHz of graph ① of FIG. 6. Further, when there are defects in the print head such as a crack, vibration signals detected from the actuator, as on graph ③ shown in FIG. 6, do not show the shape of the vibration signal on graph ① shown in FIG. 6. Therefore, the defect determination unit 220 compares whether the resonance frequency of the Lth vibration signal, generated by the vibration of the Lth actuator, corresponds to resonance frequency of the specific vibration signal of the Lth actuator, which is generated when the print head has no defect, or whether both of the vibration signals are the same, and then determines if the print head has defects.

Below, another embodiment of a defect detection device of the print head according to the present invention will be described with reference to the accompanying drawings.

Figure 7:
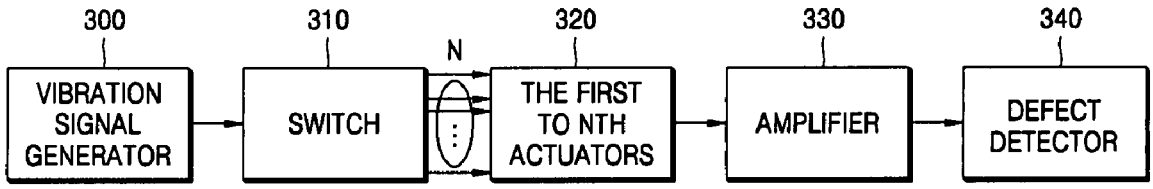
FIG. 7 illustrates a block diagram of another embodiment for explaining a defect detection device of a print head according to the present invention.

FIG. 7 illustrates a block diagram of another embodiment for explaining a defect detection device of a print head according to the present invention, where the defect detection device includes a vibration signal generator 300, a switch 310, first to Nth actuators 320, an amplifier 330, and a defect detector 340.

The first to Nth (N is one or more positive integer) actuators 320 provide a driving force for ejecting ink to the ink chambers (not shown). The first to Nth actuators 320 change volumes of ink chambers and allow ink to eject to the outside through nozzles from the ink chambers.

The vibration signal generator 300 generates vibration signals for vibrating the first to Nth actuators 320 and outputs the generated vibration signals to the switch 310. The vibration signal generator 300 can generate waveforms of various kinds of vibration signals. Specifically, in the present invention, it may generate sinusoidal waveforms. The first to Nth actuators 320 are vibrated by vibration signals.

The switch 310 receives generated vibration signals and outputs vibration signals to a Kth (K is any integer ranging from 1 to N) actuator among the first to Nth actuators. The switch 310 outputs vibration signals to the Kth actuator among the first to Nth actuators 320 in order to check whether a crack or an aperture occurs around the Kth actuator.

The Kth actuator is vibrated by received vibration signals and output the Kth vibration signal by vibrating the Kth actuator.

The amplifier 330 amplifies the Kth vibration signal output from the Kth actuator and outputs the amplified Kth vibration signal to the defect detector 340.

The defect detector 340 compares the Kth vibration signal of the Kth actuator, which is made to vibrate by vibration signals, with a specific vibration signal of the Kth actuator, derived there is no defect in the print head, and detect defects in the print head. Here, a specific vibration signal means an admittance change depending on a frequency change that is measured from the first to Nth actuators 320 when defects such as a crack or adhesion failure and so on do not occur in the print head having the first to Nth actuators 320, i.e., derived from a defect-free print head.

Figure 8:
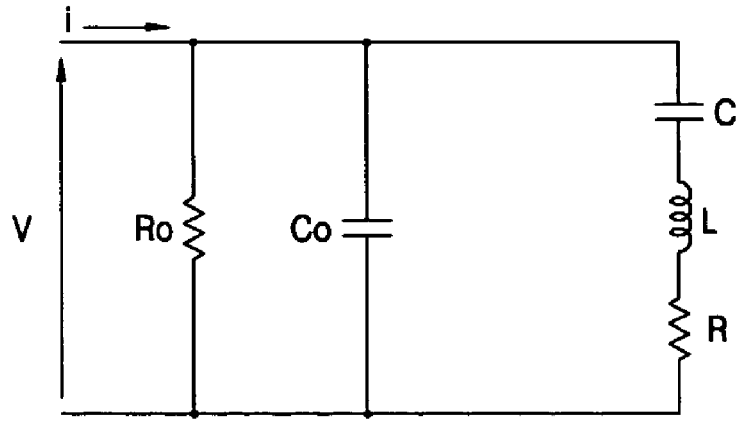
FIG. 8 illustrates a diagram of physical characteristics of an actuator with an equivalent circuit.

FIG. 8 illustrates a diagram of physical characteristics of an actuator with an equivalent circuit. Admittance for circuit shown in FIG. 8 is given by the following Expression 1.

$$Y=i/V=1/R_0+jC_0\omega+1/(R+jL\omega+1/jC\omega)=G+jB=1/Z \qquad \text{Expression 1}$$

In Expression 1, Y means admittance (the reciprocal of admittance), i means current, V means voltage, $R_0$ means the resistance of resistor $R_0$, j means imaginary unit, ω means frequency, R means the resistance of resistor R, L means the inductance of inductor L, C means the capacitance of capacitor C, G means conductance, B means susceptance and Z means impedance.

An admittance change depending on a frequency change measured from the first or Nth actuators 120 of the print head having no defect shows the same shape. That is, vibration signals of the first to Nth actuators 320 of the print head having no defect show that frequency. In other words, the resonance frequency at the level of the largest value of the admittance change is the same.

Figure 9:
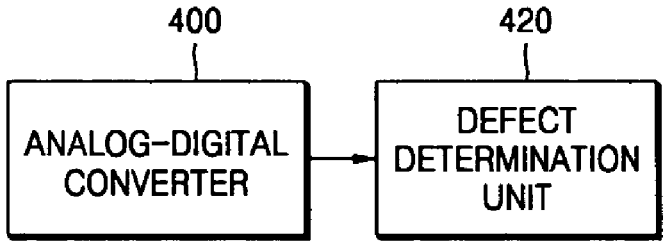
FIG. 9 illustrates a block diagram of an embodiment for explaining a defect detector shown in FIG. 7.

FIG. 9 illustrates a block diagram of an embodiment for explaining a defect detector 340 shown in FIG. 7, where the defect detector 340 includes an analog-digital converter 400 and a defect determination unit 420.

The analog-digital converter 400 converts the Kth vibration signal into a digital signal and outputs the converted signals to the defect determination unit 420.

The defect determination unit 420 compares the Kth vibration signal converted into a digital signal with the specific vibration signal that is a digital signal and determines if the print head has defects.

The defect determination unit 420 determines if the print head has defects depending on whether a Kth vibration signal frequency having the largest value of admittance change corresponds to a specific vibration signal frequency having the largest value of the admittance change, where the Kth vibration signal reflects the changes with respect to frequency of admittance generated by the vibration of the Kth actuator.

Figure 10:
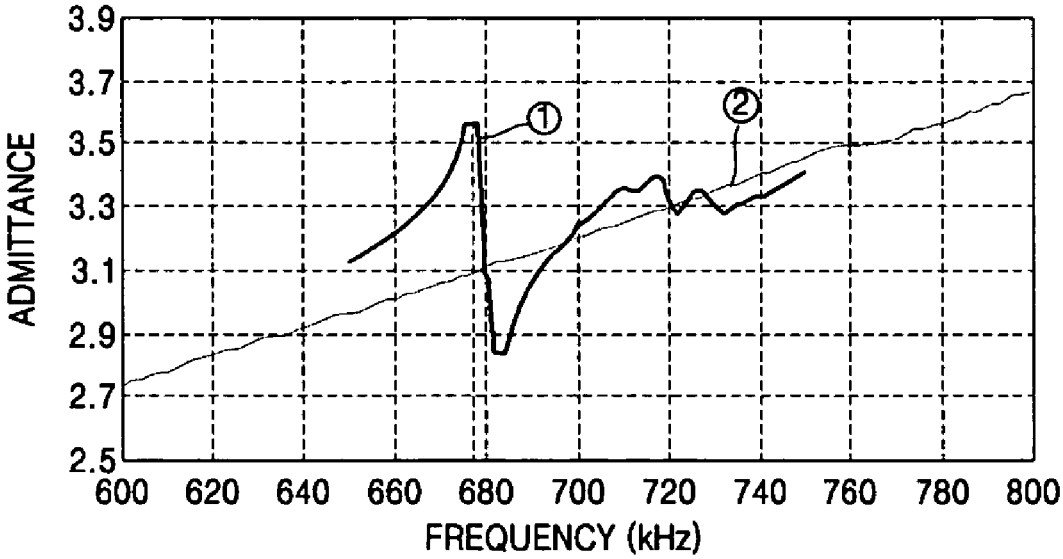
FIG. 10 illustrates a diagram of specific vibration signal detected from an actuator of a print head having no defect and vibration signal detected from an actuator of a print head having defects.

FIG. 10 illustrates a diagram of a specific vibration signal detected from an actuator of a print head having no defect and vibration signal detected from an actuator of a print head having defects. Graph ① shown in FIG. 10 shows the specific vibration signal detected from the actuator of the print head having no defect, and graph ② shown in FIG. 10 shows the vibration signal detected from the actuator of the print head having defects. When there is no defect in the print head, vibration signals detected from the actuator have the same resonance frequency, 677 kHz, as on graph ① shown in FIG. 10. However, when there are defects in the print head, vibration signals detected from the actuator are different from those of graph ② shown in FIG. 10. The reason that the vibration signals are different is that vibration signals of the Kth actuator are not properly detected due to defects, such as a crack or adhesion failure, etc., around the Kth actuator.

Therefore, the defect determination unit 420 checks whether the resonance frequency of the Kth vibration signal, generated by the vibration of the Kth actuator, corresponds to the resonance frequency of a specific vibration signal of the Kth actuator, which is generated when the print head has no defect, or whether both of the vibration signals are the same, and then determines if the print head has defects.

Below, a method of detecting defects in a print head according to the present invention will be described with reference to the accompanying drawings.

Figure 11:
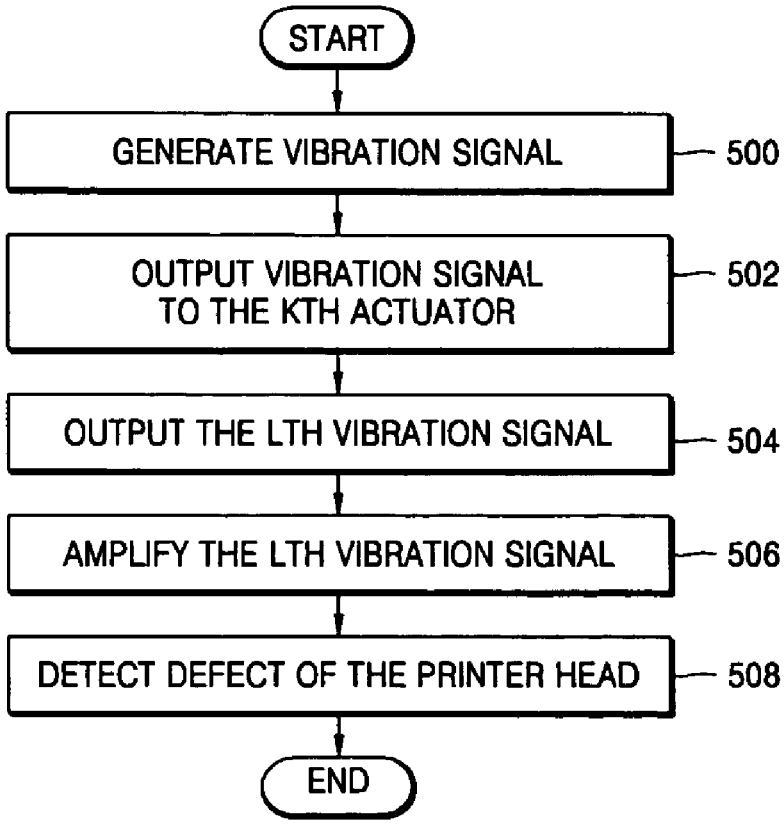
FIG. 11 illustrates a flowchart of an embodiment for explaining a method of detecting defects in the print head according to the present invention.

FIG. 11 illustrates a flowchart of an embodiment for explaining a method of detecting defects in the print head according to the present invention.

First, vibration signals for vibrating the first to Nth (N is one or more positive integer) actuators are generated (operation 500). Waveforms of various kinds of vibration signals can be generated, and specifically, in the present invention, sinusoidal waveforms may be generated.

After operation 500, the generated vibration signals are received and output to the Kth (K is any integer ranging from 1 to N) actuator of the first to Nth actuators (operation 502). The generated vibration signals are output to the Kth actuator among the first to Nth actuators 120 in order to check whether a crack or an aperture occurs around the Kth actuator.

The Kth actuator is vibrated by the received vibration signals.

After operation 502, vibration signals of one or more among the first to Nth actuators, vibrating concurrently with the vibration of the Kth actuator, are received and the Lth vibration signal, which corresponds to a vibration signal of the Lth (L is any integer ranging from 1 to N) actuator adjacent to the Kth actuator among the received vibration signals, is output (operation 504). Specifically, a vibration signal means a maximum voltage change reflecting a frequency change measured from the vibrating actuators. When the actuators are vibrated, a voltage occurs due to physical characteristics of the actuators. Therefore, a maximum voltage change by a frequency change corresponding to the frequency change of the vibration signals with respect to such generated voltage can be detected.

After operation 504, the Lth vibration signal is amplified (operation 506).

After operation 506, the Lth vibration signal is compared with a specific vibration signal of the Lth actuator when there is no defect in the print head, and then defects in the print head are detected (operation 508). A specific vibration signal means a maximum voltage change depending on a frequency change measured from the first to Nth actuators 120 when defects, such as a crack or an aperture due to adhesion failure, etc., do not occur in the print head having the first to Nth actuators 120. A vibration signal corresponding to a maximum voltage change depending on the frequency change shows the same shape in all of the first to the Nth actuators 120 of the print head having no defect. That is, vibration signals of the first to the Nth actuators 120 of the print head having no defect show that frequency. In other words, the resonance frequency is the same at the level of the largest value of maximum voltage change.

Figure 12:
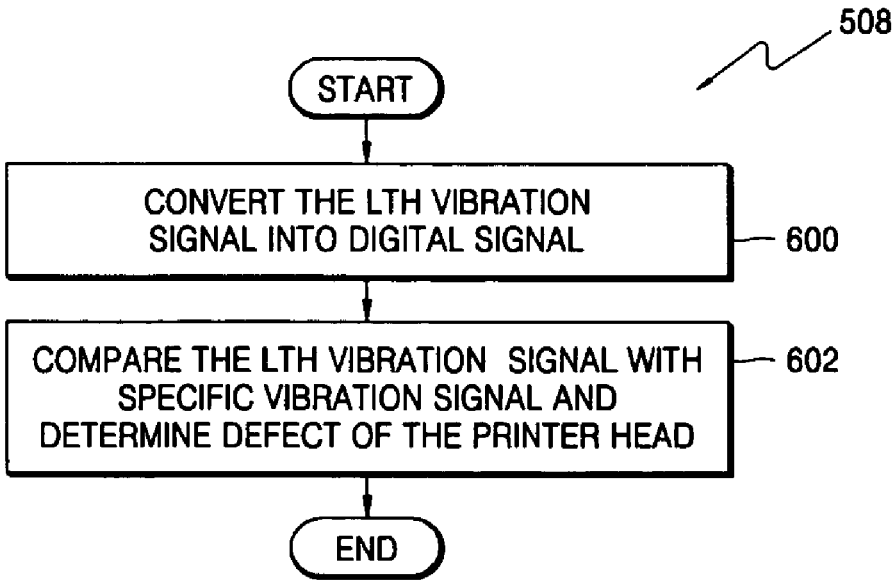
FIG. 12 illustrates a flowchart of an embodiment for explaining operation 508 shown in FIG. 11.

FIG. 12 illustrates a flowchart of an embodiment for explaining operation 508 shown in FIG. 11.

The Lth vibration signal is converted into a digital signal (operation 600).

After operation 600, the Lth vibration signal converted into a digital signal is compared with the specific vibration signal, which is a digital signal, and defects in the print head are determined (operation 602).

Defects in the print head are determined depending on whether frequency having the largest value of maximum voltage change corresponds to frequency having the largest value of maximum voltage change of specific vibration signal, where the Lth vibration signal means a frequency change of maximum voltage generated by the vibration of the Lth actuator. As shown in FIG. 6, the method compares whether the resonance frequency of the Lth vibration signal, generated by the vibration of the Lth actuator, corresponds to the resonance frequency of a specific vibration signal of the Lth actuator, which is generated when there is no defect in the print head, or whether both of vibration signals are the same, and then defects in the print head are determined.

Below, another embodiment of a method of detecting defects in the print head according to the present invention will be described with reference to the accompanying drawings.

Figure 13:
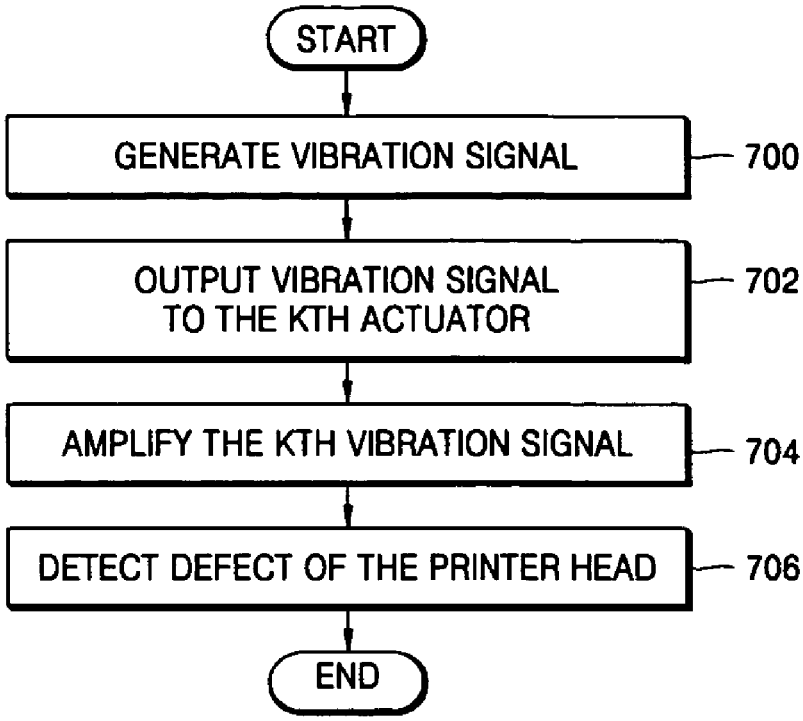
FIG. 13 illustrates a flowchart of another embodiment for explaining a method of detecting defects in the print head according to the present invention.

FIG. 13 illustrates a flowchart of another embodiment for explaining a method of detecting defects in the print head according to the present invention.

First, vibration signals for vibrating the first to Nth (N is one or more positive integer) actuators are generated (operation 700). Specifically, in the present invention, sinusoidal waveforms may be generated.

After operation 700, the generated vibration signals are received and vibration signals are output to the Kth (K is any integer ranging from 1 to N) actuator among the first to Nth actuators (operation 702).

The Kth actuator is vibrated by the received vibration signals.

After operation 702, the Kth vibration signal is amplified (operation 704).

After operation 704, the Kth vibration signal of the Kth actuator that is made to vibrate by vibration signal is received, the received Kth vibration signal is compared with a specific vibration signal of the Kth actuator when there is no defect in the print head, and defects in the print head are detected (operation 706).

A specific vibration signal means an admittance change depending on a frequency change measured from the first to Nth actuators 120 when defects, such as a crack or an aperture due to adhesion failure, and so on, do not occur in the print head having the first to Nth actuators 120. An admittance change depending on a frequency change measured from the first to Nth actuators 120 of the print head having no defect shows the same shape. That is, vibration signals of the first to Nth actuators 120 of the print head having no defect show that frequency. In other words, the resonance frequency is the same at the level of the highest value of an admittance change.

Figure 14:
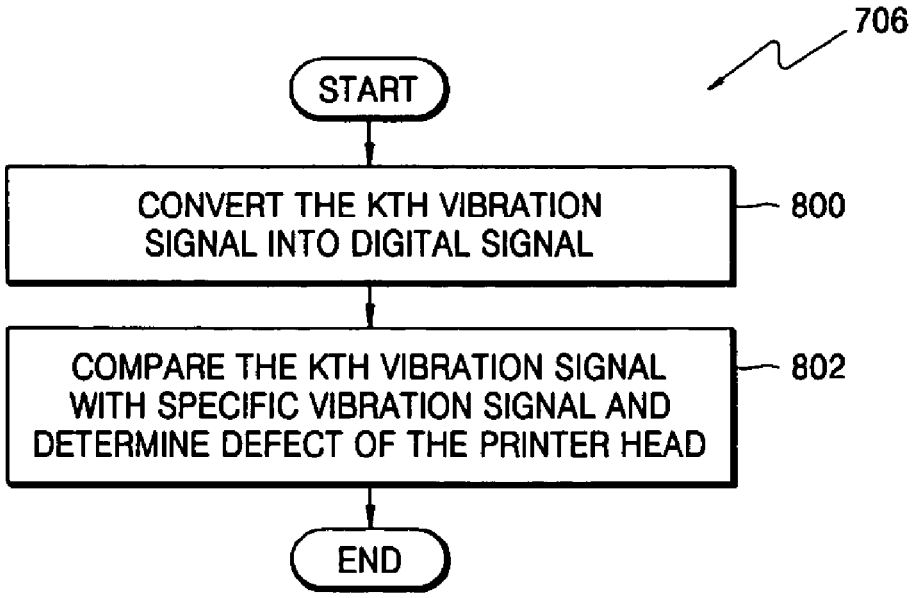
FIG. 14 illustrates a flowchart of an embodiment for explaining operation 706 shown in FIG. 13.

FIG. 14 illustrates a flowchart of an embodiment for explaining operation 706 shown in FIG. 13.

The Kth vibration signal is converted into a digital signal (operation 800).

After operation 800, the Kth vibration signal converted into a digital signal is compared with the specific vibration signal, which is a digital signal, and then defects in the print head are determined (operation 802).

Defects in the print head are determined depending on whether the Kth vibration signal frequency having the largest value of an admittance change corresponds to the specific vibration signal frequency having the largest value of the admittance change, where the Kth vibration signal means a change in frequency of admittance generated by the vibration of the Kth actuator.

As shown in FIG. 10, the method compares whether the resonance frequency of the Kth vibration signal, generated by the vibration of the Kth actuator, corresponds to the resonance frequency of a specific vibration signal of the Kth actuator, determined when there is no defect in the print head, or whether both vibration signals are the same, and defects in the print head are determined.

Below, another embodiment of a method of detecting defects in the print head according to the present invention will be described with reference to the accompanying drawings.

Figure 15:
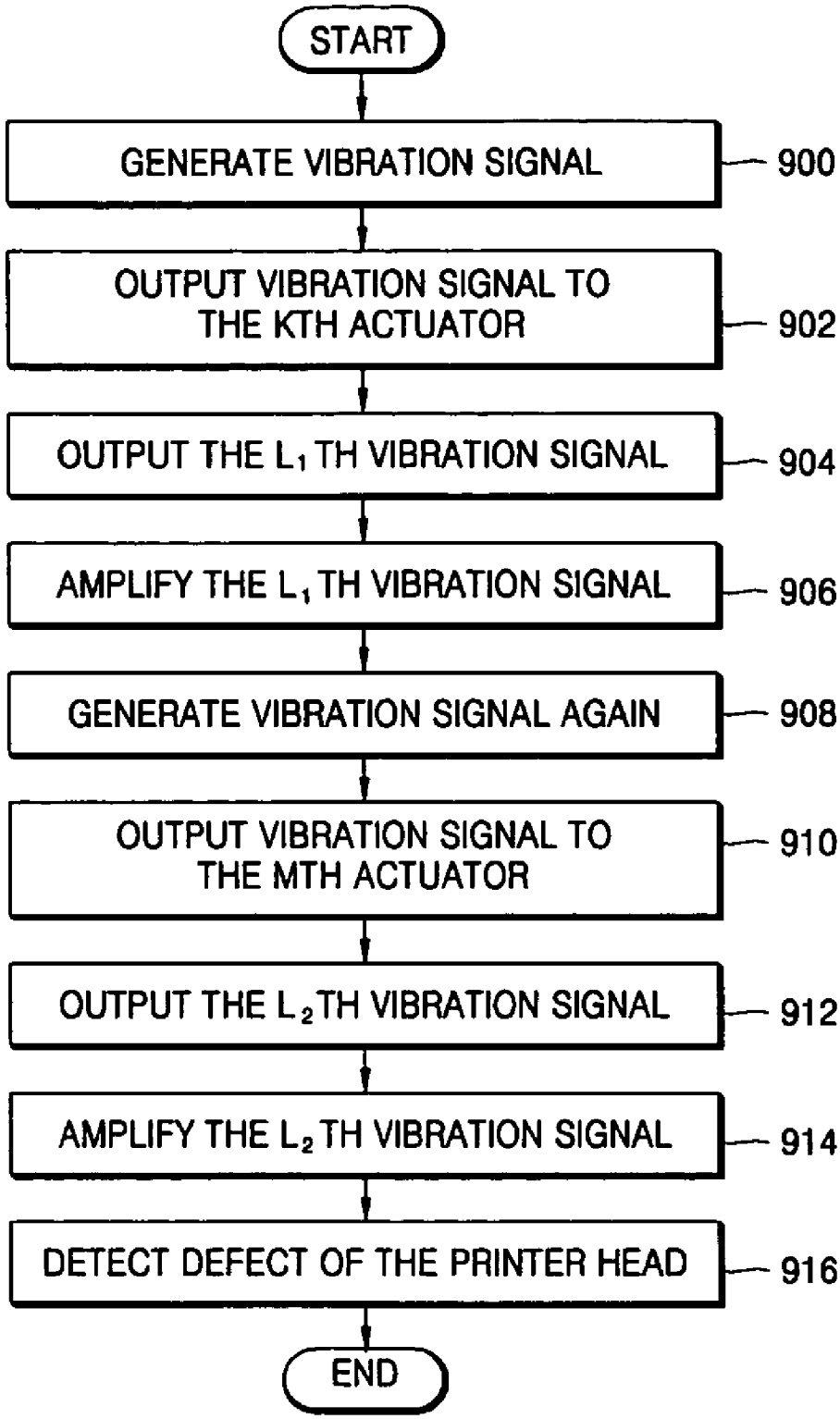
FIG. 15 illustrates a flowchart of another embodiment for explaining a method of detecting defects in the print head according to the present invention.

FIG. 15 illustrates a flowchart of another embodiment for explaining a method of detecting defects in the print head according to the present invention.

First, vibration signals for vibrating the first to Nth (N is one or more positive integer) actuators are generated (operation 900). Specifically, sinusoidal waveforms may be generated.

After operation 900, the generated vibration signals are received and the vibration signals are output to the Kth (K is any integer ranging from 1 to N) actuator of the first to Nth actuators (operation 902).

The Kth actuator is vibrated by the received vibration signal.

After operation 902, vibration signals of one or more of the first to Nth actuators vibrating concurrently with the vibration of the Kth actuator are received and the $L_1$th vibration signal, which corresponds to a vibration signal of the Lth (L is any integer ranging from 1 to N) actuator adjacent to the Kth actuator among the received vibration signals, is output (operation 904).

After operation 904, the $L_1$th vibration signal is amplified (operation 906).

After operation 906, vibration signals are generated again (operation 908).

After operation 908, the generated vibration signals are received and vibration signals are output to the Mth (M is any integer ranging from 1 to N) actuator adjacent to the Lth actuator among the first to Nth actuators (operation 910).

After operation 910, vibration signals of one or more among the first to Nth actuators vibrating concurrently with the vibration of the Mth actuator are received and the $L_2$th vibration signal, which is another vibration signal of the Lth actuator among the received vibration signals, is output (operation 912).

After operation 912, the $L_2$th vibration signal is amplified (operation 914).

After operation 914, the $L_1$th vibration signal is compared with a specific vibration signal of the Lth actuator, determined when there is no defect in the print head, the $L_2$th vibration signal is compared with the specific vibration signal, and then defects in the print head are detected (operation 916).

Figure 16:
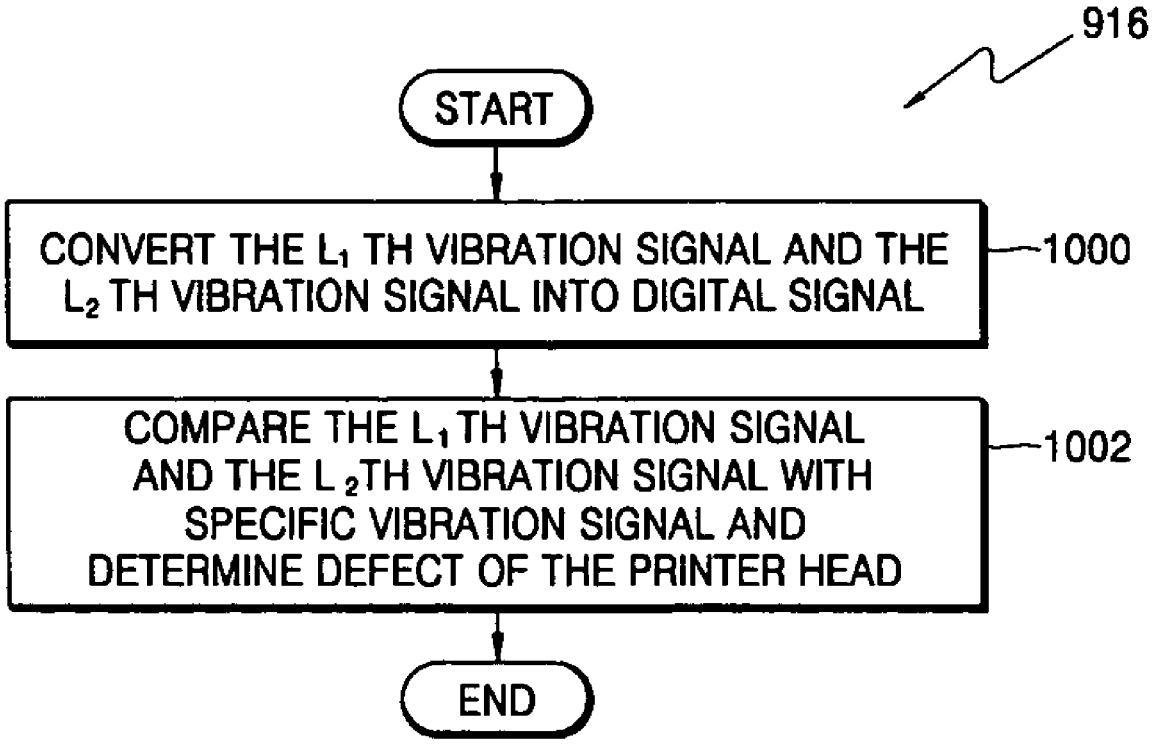
FIG. 16 illustrates a flowchart of an embodiment for explaining operation 916 shown in FIG. 15.

FIG. 16 illustrates a flowchart of an embodiment for explaining operation 916 shown in FIG. 15.

The $L_1$th vibration signal and the $L_2$th vibration signal are converted into digital signals (operation 1000).

After operation 1000, the $L_1$th vibration signal converted into a digital signal is compared with a specific vibration signal, which is a digital signal, the $L_2$th vibration signal converted into a digital signal is compared with the specific vibration signal, and defects in the print head are determined.

Specifically, defects in the print head are determined depending on whether a first frequency having the largest of maximum voltage changes of the $L_1$th vibration signal, and a second frequency having the largest of maximum voltage changes of the $L_2$th vibration signal, correspond to the frequency of the specific vibration signal having the largest of maximum voltage changes, where the $L_1$th vibration signal and the $L_2$th vibration signal, respectively, represent a change in frequency of maximum voltage generated by the vibration of the Lth actuator.

A specific vibration signal means a maximum voltage change depending on a frequency change respectively measured from the first to Nth actuators 120 when defects, such as a crack or an aperture due to adhesion failure, etc., do not occur in the print head having the first to Nth actuators 120. Vibration signals, i.e., a maximum voltage change depending on a frequency change, show the same shape in all of the first to Nth actuators 120 of the print head having no defect. That is, vibration signals of the first to Nth actuators 120 of the print head having no defect show that frequency. In other words, the resonance frequency is the same at the level of the highest value of maximum voltage change.

Therefore, it is comprehensively taken into account whether the first frequency having the largest of maximum voltage changes of the $L_1$th vibration signal and the second frequency having the largest of maximum voltage changes of the $L_2$th vibration signal correspond to the specific vibration signal frequency having the largest of maximum voltage changes, or whether the $L_1$th vibration signal and the $L_2$th vibration signal correspond to a specific vibration signal of the Lth actuator, and then defects in the print head is determined.

As described above, a defect detection device and a method of detecting defects in the print head according to the present invention make it possible to detect defects such as a crack or adhesion failure in the print head, using simple elements.

Therefore, the defect detection device and the method of detecting defects in the print head according to the present invention make it possible to easily determine the quality of the print head at a low cost.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A defect detection device of a print head, comprising:

first to Nth (N is a positive integer) actuators providing a driving force for ejecting ink to ink chambers;

a vibration signal generator generating vibration signals for vibrating the first to Nth actuators;

a switch receiving the generated vibration signals and outputting the vibration signals to a Kth (K is any integer ranging from 1 to N) actuator among the first to Nth actuators; and a defect detector receiving a selected vibration signal of a selected actuator that is made to vibrate by the vibration signals, comparing the received selected vibration signal with a specific vibration signal of the selected actuator, the specific vibration signal of the selected actuator derived from a print head having no defects, and detecting defects in the print head, wherein:

the defect detector includes:

an analog-digital converter converting the selected vibration signal into a digital signal; and a defect determination unit comparing the selected vibration signal converted into a digital signal with the specific vibration signal that is a digital signal and determining if the print head has defects, the selected vibration signal reflects a frequency of an admittance generated by the vibration of the selected actuator, and the defect determination unit determines if the print head has defects depending on whether a selected vibration signal frequency having a largest admittance change corresponds to a specific vibration signal frequency having a largest admittance change.

2. The defect detection device of a print head as claimed in claim 1, further comprising:

another switch receiving vibration signals of one or more among the first to Nth actuators vibrating concurrently with the vibration of the Kth actuator and outputting an Lth vibration signal as the vibration signal of the selected actuator, which corresponds to a vibration signal of an Lth actuator (L is any integer ranging from 1 to N) adjacent to the Kth actuator, from among the received vibration signals;

the defect detector comparing the Lth vibration signal output from the another switch with a specific vibration signal of the Lth actuator, the specific vibration signal of the Lth actuator derived from a print head having no defects, and detecting defects in the print head.

3. The defect detection device of a print head as claimed in claim 2, wherein the vibration signal generator generates sinusoidal waveforms.

4. The defect detection device of a print head as claimed in claim 2, further comprising an amplifier amplifying the Lth vibration signal output from the second switch and outputting the amplified Lth vibration signal to the defect detector.

5. The defect detection device of a print head as claimed in claim 2, wherein the defect detector comprises:

an analog-digital converter converting the Lth vibration signal output from the second switch into a digital signal; and a defect determination unit comparing the Lth vibration signal converted into a digital signal with the specific vibration signal, which is a digital signal, and determining if the print head has defects.

6. The defect detection device of a print head as claimed in claim 2, wherein the Lth vibration signal means a change of a maximum voltage depending on a frequency change generated by the vibration of the Lth actuator, and the defect determination unit determines if the print head has defects depending on whether an Lth vibration signal frequency having a largest maximum voltage change corresponds to a specific vibration signal frequency having a largest maximum voltage change.

7. The defect detection device of a print head as claimed in claim 1, wherein the vibration signal generator generates sinusoidal waveforms.

8. The defect detection device of a print head as claimed in claim 1, further comprising an amplifier amplifying the selected vibration signal and outputting the amplified selected vibration signal to the defect detector.

9. The defect detection device of a print head as claimed in claim 1, wherein, when the defect detection device is part of a first print head, the print head having no defects is not the first print head.

10. A method of detecting defects in a print head, comprising:

(a) generating vibration signals for vibrating first to Nth (N is one or more positive integer) actuators;

(b) receiving the generated vibration signals and outputting the vibration signals to a Kth (K is any integer ranging from 1 to N) actuator among the first to Nth actuators; and (c) receiving a selected vibration signal of a selected actuator that is made to vibrate by the vibration signals, comparing the received selected vibration signal with a specific vibration signal of the selected actuator, the specific vibration signal of the selected actuator derived from a print head having no defects, and detecting defects in the print head, wherein:

receiving the selected vibration signal includes:

(c1) converting the selected vibration signal into a digital signal; and (c2) comparing the selected vibration signal converted into a digital signal with the specific vibration signal of the selected actuator, which is a digital signal, and determining if the print head has defects, in comparing the selected vibration signal with the specific vibration signal of the selected actuator, the selected vibration signal reflects a frequency of an admittance generated by the vibration of the selected actuator, and defects in the print head are determined depending on whether a selected vibration signal frequency having a largest admittance change corresponds to a specific vibration signal frequency having a largest admittance change.

11. The method of detecting defects in a print head as claimed in claim 10, wherein:

the selected vibration signal is an Lth vibration signal, which corresponds to a vibration signal of an Lth (L is any integer ranging from 1 to N) actuator adjacent to the Kth actuator; and comparing includes comparing the Lth vibration signal with a specific vibration signal of the Lth actuator, the specific vibration signal of the Lth actuator derived from a print head having no defects, and detecting defects in the print head.

12. The method of detecting defects in a print head as claimed in claim 11, wherein, in generating the vibration signals, sinusoidal waveforms are generated.

13. The method of detecting defects in a print head as claimed in claim 11, further comprising amplifying the Lth vibration signal after receiving the vibration signals of one or more of the first to Nth actuators and before comparing the Lth vibration signal with the specific vibration signal of the Lth actuator.

14. The method of detecting defects in a print head as claimed in claim 11, wherein comparing the Lth vibration signal with the specific vibration signal of the Lth actuator comprises:

(d1) converting the Lth vibration signal into a digital signal; and (d2) comparing the Lth vibration signal converted into a digital signal with the specific vibration signal of the Lth actuator, which is a digital signal, and determining if the print head has defects.

15. The method of detecting defects in a print head as claimed in claim 11, wherein, in comparing the Lth vibration signal with the specific vibration signal of the Lth actuator, the Lth vibration signal means a change of a maximum voltage depending on a frequency change generated by the vibration of the Lth actuator, and defects in the print head are determined depending on whether an Lth vibration signal frequency having a largest maximum voltage change corresponds to a specific vibration signal frequency having a largest maximum voltage change.

16. The method of detecting defects in a print head as claimed in claim 10, wherein, in generating the vibration signals, sinusoidal waveforms are generated.

17. The method of detecting defects in a print head as claimed in claim 10, further comprising amplifying the selected vibration signal after receiving the generated vibration signals and before receiving the selected vibration signal.

18. The method of detecting defects in a print head as claimed in claim 10, wherein, when the method is performed on a first print head, the print head having no defects is not the first print head.

19. A method of detecting defects in a print head, comprising:

(a) generating vibration signals for vibrating first to Nth (N is one or more positive integer) actuators;

(b) receiving the generated vibration signals and outputting the vibration signals to a Kth (K is any integer ranging from 1 to N) actuator among the first to Nth actuators;

(c) receiving vibration signals of one or more of the first to Nth actuators vibrating concurrently with the vibration of the Kth actuator and outputting an $L_1$th vibration signal, which corresponds to a vibration signal of an Lth (L is any integer ranging from 1 to N) actuator adjacent to the Kth actuator, from among the received vibration signals;

(d) generating the vibration signal again;

(e) receiving the generated vibration signal and outputting the vibration signal to an Mth (M is any integer ranging from 1 to N) actuator adjacent to the Lth actuator among the first to Nth actuators;

(f) receiving vibration signals of one or more of the first to Nth actuators vibrating concurrently with the vibration of the Mth actuator and outputting an $L_2$th vibration signal, which corresponds to another vibration signal of the Lth actuator among the received vibration signals; and (g) comparing the $L_1$th vibration signal with a specific vibration signal of the Lth actuator, the specific vibration signal of the Lth actuator derived from a print head having no defects, comparing the $L_2$th vibration signal with the specific vibration signal of the Lth actuator, and detecting defects in the print head.

20. The method of detecting defects in a print head as claimed in claim 19, wherein, in generating the vibration signals, sinusoidal waveforms are generated.

21. The method of detecting defects in a print head as claimed in claim 19, further comprising:

a step of amplifying the $L_1$th vibration signal after receiving the vibration signals and before generating the vibration signal again; and a step of amplifying the $L_2$th vibration signal after receiving the vibration signals and before comparing the $L_1$th vibration signal with the specific vibration signal of the Lth actuator.

22. The method of detecting defects in a print head as claimed in claim 19, wherein comparing the $L_1$th vibration signal with the specific vibration signal of the Lth actuator comprises:

(g1) converting the $L_1$th vibration signal and the $L_2$th vibration signal into digital signals; and (g2) comparing the $L_1$th vibration signal converted into a digital signal with the specific vibration signal of the Lth actuator, which is a digital signal, comparing the $L_2$th vibration signal converted into a digital signal with the specific vibration signal of the Lth actuator, and determining if the print head has defects.

23. The method of detecting defects in a print head as claimed in claim 19, wherein in comparing the $L_1$th vibration signal with the specific vibration signal of the Lth actuator, the $L_1$th vibration signal and the $L_2$th vibration signal, respectively, means a change of a maximum voltage depending on a frequency change generated by the vibration of the Lth actuator, and defects in the print head are determined depending on whether a first frequency having the largest of maximum voltage changes of the $L_1$th vibration signal and a second frequency having the largest of maximum voltage change of the $L_2$th vibration signal corresponds to frequency having the largest of maximum voltage changes of a specific vibration signal.

24. A defect detection device of a print head, comprising:

first to Nth (N is a positive integer) actuators providing a driving force for ejecting ink to ink chambers;

a vibration signal generator generating vibration signals for vibrating the first to Nth actuators;

a switch receiving the generated vibration signals and outputting the vibration signals to a Kth (K is any integer ranging from 1 to N) actuator among the first to Nth actuators; and a defect detector receiving a selected vibration signal of a selected actuator that is made to vibrate by the vibration signals, comparing the received selected vibration signal with a specific vibration signal of the selected actuator, the specific vibration signal of the selected actuator derived from a print head having no defects, and detecting defects in the print head, wherein:

the selected vibration signal reflects a frequency of an admittance generated by the vibration of the selected actuator, and the defect determination unit determines if the print head has defects depending on whether a selected vibration signal frequency having a largest admittance change corresponds to a specific vibration signal frequency having a largest admittance change.

25. A method of detecting defects in a print head, comprising:

(a) generating vibration signals for vibrating first to Nth (N is one or more positive integer) actuators;

(b) receiving the generated vibration signals and outputting the vibration signals to a Kth (K is any integer ranging from 1 to N) actuator among the first to Nth actuators; and (c) receiving a selected vibration signal of a selected actuator that is made to vibrate by the vibration signals, comparing the received selected vibration signal with a specific vibration signal of the selected actuator, the specific vibration signal of the selected actuator derived from a print head having no defects, and detecting defects in the print head, wherein:

in comparing the selected vibration signal with the specific vibration signal of the selected actuator, the selected vibration signal reflects a frequency of an admittance generated by the vibration of the selected actuator, and defects in the print head are determined depending on whether a selected vibration signal frequency having a largest admittance change corresponds to a specific vibration signal frequency having a largest admittance change.

* * * * *